United States Patent [19]

Brandon

[11] Patent Number: 4,889,237

[45] Date of Patent: Dec. 26, 1989

[54] PILL CONTAINER CALENDAR

[76] Inventor: Phillip J. Brandon, 3207 Hoyt Ave. #3, Everett, Wash. 98201

[21] Appl. No.: 224,957

[22] Filed: Jul. 27, 1988

[51] Int. Cl.[4] ..... B65D 85/56

[52] U.S. Cl. ..... 206/534; 206/538; 206/459

[58] Field of Search ..... 206/534, 538, 558, 459

[56] References Cited

U.S. PATENT DOCUMENTS

| | | | |
|---|---|---|---|
| 3,225,913 | 12/1965 | Lee | 206/534 |
| 3,278,010 | 10/1966 | Katz | 206/42 |
| 3,324,995 | 6/1967 | Sharp, Jr. | 206/42 |
| 3,385,421 | 5/1968 | Huck | 206/42 |
| 3,450,306 | 6/1969 | Gill | 221/71 |
| 3,494,322 | 2/1970 | Dubbels | 116/121 |
| 3,638,603 | 2/1972 | Conover | 116/121 |
| 3,703,955 | 11/1972 | Inacker | 206/42 |
| 3,844,408 | 10/1974 | Relyea | 206/534 |
| 3,908,877 | 9/1975 | Kosisky | 206/459 |
| 3,921,806 | 11/1975 | Wawracz | 206/534 |
| 4,039,080 | 8/1977 | Cappuccilli | 206/534 |
| 4,148,273 | 4/1979 | Hollingsworth et al. | 116/325 |
| 4,318,477 | 3/1982 | Kerpe | 206/534 |
| 4,534,468 | 8/1985 | Nuckols et al. | 206/534 |
| 4,573,580 | 3/1986 | Messer | 206/534 |
| 4,593,819 | 6/1986 | Will | 206/538 |
| 4,617,557 | 10/1986 | Gordon | 340/568 |
| 4,749,085 | 6/1988 | Denney | 206/534 |
| 4,757,898 | 7/1988 | Klein | 206/459 |

*Primary Examiner*—Arnold Rosenthal

*Attorney, Agent, or Firm*—Ward Brown; Robert W. Beach

[57] ABSTRACT

An upright calendar holder has spaced front and back panels for receiving a calendar sheet therebetween. The front panel is transparent for viewing of the calendar sheet. Separate multicompartment containers are mountable on the holder, one such container being attachable adjacent to each date-indicating square of the calendar sheet.

17 Claims, 2 Drawing Sheets

PILL CONTAINER CALENDAR

BACKGROUND OF THE INVENTION

1. Field of the Invention

The present invention relates to medication containers and dispensers. More specifically, the present invention relates to a monthly calendar holder having several multicompartment pill containers, one for each day of the month, for easy identification of the last daily dose taken and, accordingly, the next daily dose to be taken.

2. Prior Art

Pharmaceutical pills commonly are provided in single compartment bottles with instructions as to the daily dosage (amount and frequency). Even when the same dosage applies over a long period, it is not uncommon for a patient to forget to take a pill or to forget whether or not a pill was taken at the appropriate time.

Hollingsworth et al. U.S. Pat. No. 4,148,273, issued Apr. 10, 1979, discloses a "Medicine Management Device" in the form of a pegboard with color-coded pegs to indicate the time of day that each of a plurality of different medications is to be taken but does not assist the patient in remembering whether or not the medication was taken at the appropriate time.

Each of the following U.S. Pat. Nos. discloses a multicompartment container/dispenser and these general types of devices are useful because the appropriate compartment may be checked to see whether or not the last dose was taken:

Katz U.S. Pat. No. 3,278,010, issued Oct. 11, 1966;
Messer U.S. Pat. No. 4,573,580, issued Mar. 4, 1986;
Cappuccilli U.S. Pat. No. 4,039,080, issued Aug. 2, 1977;
Inacker U.S. Pat. No. 3,703,955, issued Nov. 28, 1972;
Conover U.S. Pat. No. 3,638,603, issued Feb. 1, 1972;
Wawracz U.S. Pat. No. 3,921,806, issued Nov. 25, 1975;
Will U.S. Pat. No. 4,593,819, issued June 10, 1986.

Of the above patents, it is believed that Katz U.S. Pat. No. 3,278,010 is somewhat more pertinent to the present invention because it incorporates a calendar.

Another approach has been to provide pharmaceutical pills in a blister pack sheet or strip with each pill compartment labeled for identification of the appropriate day for taking the pill or designed for use with a container/dispenser having such an identification, as described in the following Pat. Nos.:

Dubbels U.S. Pat. No. 3,494,322, issued Feb. 10, 1970;
Nuckols et al. U.S. Pat. No. 4,534,468, issued Aug. 13, 1985;
Sharp, Jr., U.S. Pat. No. 3,324,995, issued June 13, 1967;
Gill U.S. Pat. No. 3,450,306, issued June 17, 1969;
Huok U.S. Pat. No. 3,385,421, issued May 28, 1968;
Gordon U.S. Pat. No. 4,617,557, issued Oct. 14, 1986.

SUMMARY OF THE INVENTION

The principal object of the present invention is to provide a novel container for pharmaceutical pills which makes it easy to keep track of daily doses taken and to be taken, even by people with limited memory, which is easy to use, even by people with limited dexterity, and which does not require special packaging so that such container is adapted for pills of different shapes and sizes.

It also is an object to provide such a container of simple inexpensive construction, yet durable and usable over a long period.

Another object is to provide such a container in a form requiring filling from standard bottles only infrequently, such as once each month.

An additional object is to provide such a container in compact form so as to be unobtrusive and adapted for convenient mounting out of the reach of children.

In the preferred embodiment of the present invention the foregoing objects are accomplished by providing an upright holder for monthly calendar sheets having the usual numbered squares representing the days of the month, and several separate multicompartment containers mountable on the holder, one for each day of the month. The holder has an upright back panel or backing board for convenient attachment to an upright surface such as a wall, a door or a cabinet and a transparent front panel through which the calendar sheet is viewed. Such front panel has a horizontal slot adjacent to each row of date-indicating squares for reception of mounting projections extending rearward from the separate multicompartment containers. The containers have separate lids for the separate compartments and are conveniently manually detachable when emptied and for ease in filling. A separate insert card can be provided for personalized emergency or medical information, for example.

DETAILED DESCRIPTION

Figure 1:
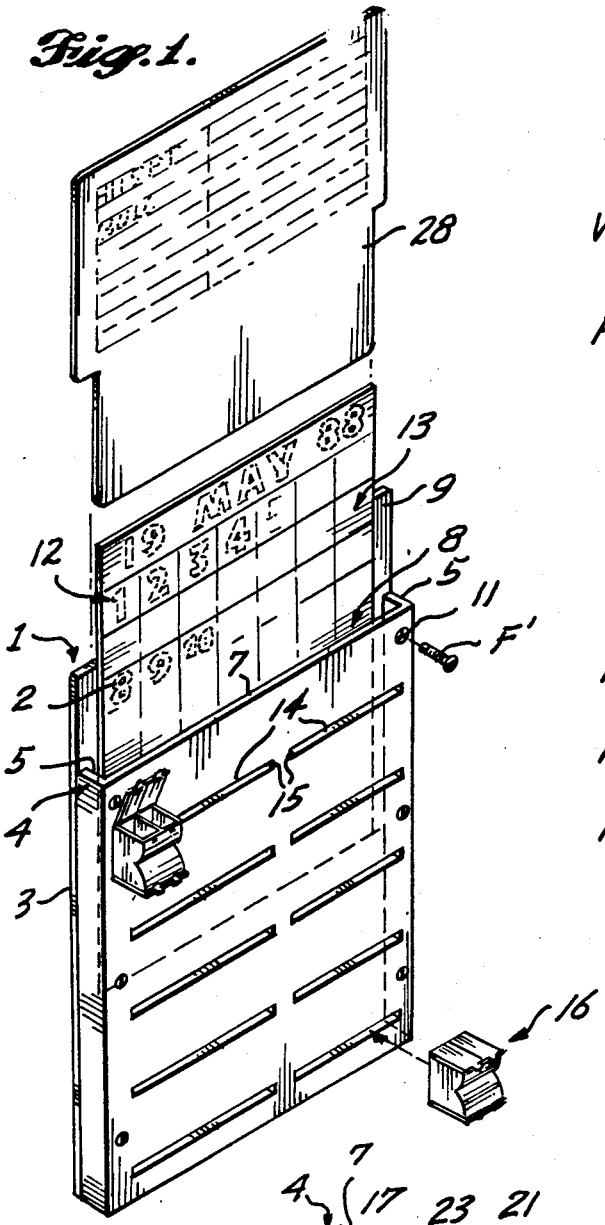
FIG. 1 is a somewhat diagrammatic top perspective of a pill container calendar in accordance with the present invention with some parts shown in exploded relationship.
Figure 2:
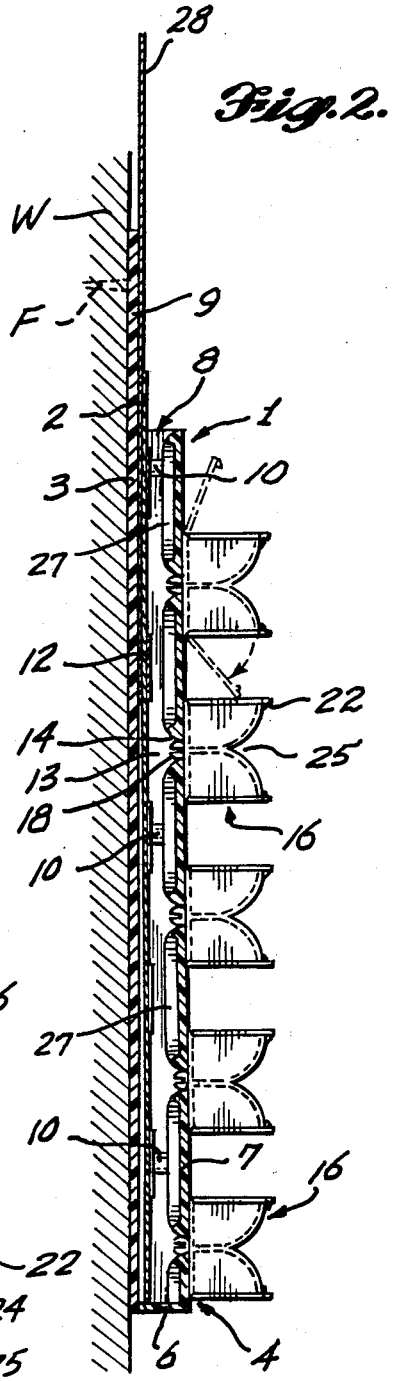
FIG. 2 is a vertical central section of the pill container calendar of FIG. 1 with parts assembled.

With reference to FIGS. 1 and 2, the pill container calendar in accordance with the present invention includes a composite calendar including a holder 1 for a monthly calendar insert sheet 2. Such holder has a rigid sheet material back panel or backing board 3 and an attached front panel 4. Such front panel has continuous integral side flanges 5 and a continuous integral bottom flange 6 spacing the front upright face portion 7 of panel 4 outward from the backing board 3 but with an open space 8 at the top for reception of the calendar insert sheet 2.

The backing board 3 has a top portion 9 extending upward above the top edge of the front panel 4, preferably with mounting holes for suitable fasteners F to secure the composite calendar holder to an upright surface such as a wall W. The backing board and front panel are secured together by suitable fasteners and/or adhesive. In the preferred embodiment illustrated, the side flanges 5 of the mounting board 4 have inward-projecting rounded bosses 10 with through holes 11 for screw or bolt fasteners F'.

As seen in FIG. 1, the calendar sheet 2 adapted for use with the holder 1 has horizontal rows 12 of numbered date-indicating squares. The numbered rows 12 are spaced apart vertically by horizontal blank spaces 13. In FIG. 2, the numbered rows 12 are represented as being raised from the remainder of the sheet, and it is more clearly seen that such rows are spaced apart a substantial distance, preferably a distance greater than the height of a numbered row.

A pair of aligned horizontal slots 14 is centered over each of the blank spaces 13 between the numbered rows 12. The adjacent ends 15 of each pair of slots 14 are spaced apart only a short distance providing a rigidifying joining section for the front panel 4. Each such joining section is centered over a vertical line between numbered squares below and/or above it, rather than being substantially centered with respect to an adjacent numbered square.

Figure 3:
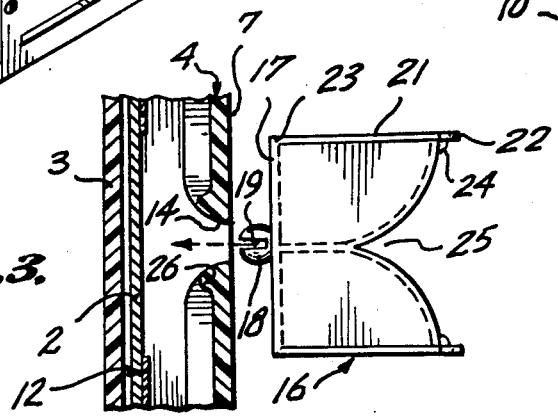
FIG. 3 is an enlarged, somewhat diagrammatic, vertical central section of a portion of such pill container calendar with parts broken away and parts shown in exploded relationship.
Figure 4:
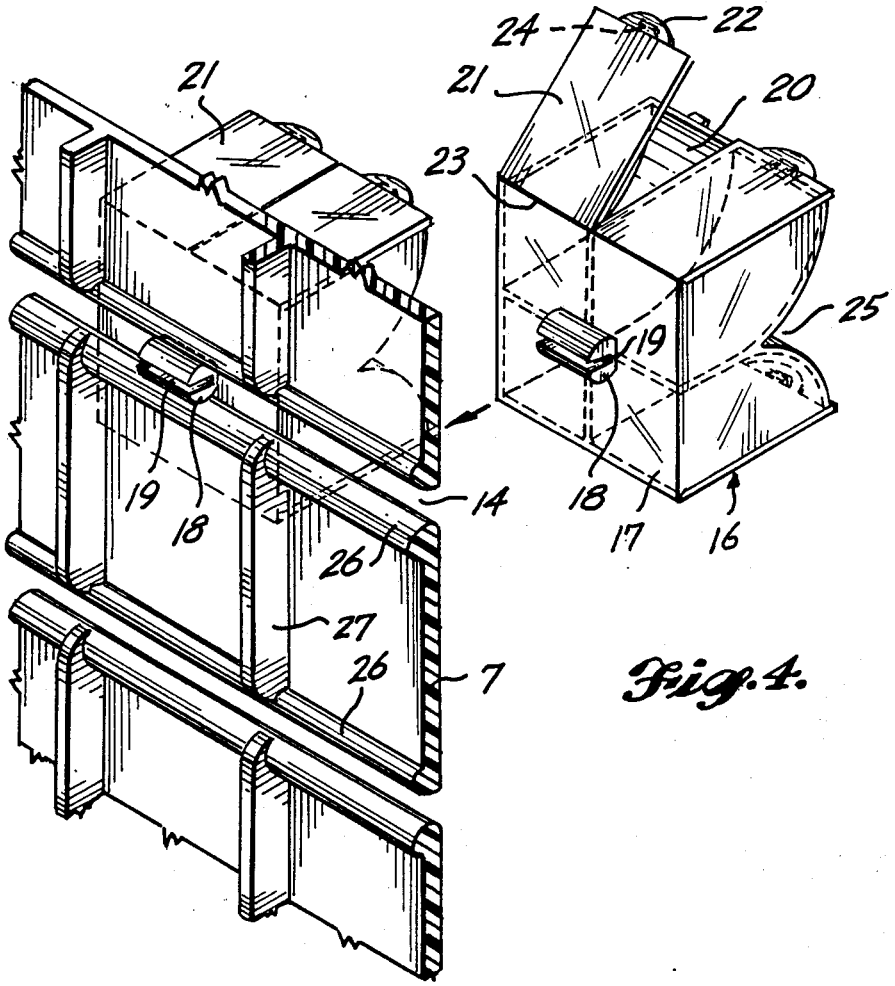
FIG. 4 is an enlarged fragmentary top rear perspective of a portion of the pill container calendar of FIG. 1.

Slots 14 are used for mounting separate multicompartment containers 16 on the front panel 4. Preferably, there is one such multicompartment container for each day of the month and, in the preferred embodiment, a separate container is manually attachable and detachable directly below each date-indicating square. As best seen in FIGS. 3 and 4, each container has a substantially planar rear face 17 from which a horizontally elongated mounting projection 18 extends. Projection 18 has convex top and bottom surfaces and a central horizontal slot 19 such that each container can be mounted in position simply by fitting its rearward-extending projection 18 in one of slots 14. The face 7 of the front panel 4 is beveled or rounded alongside each slot 14 to form an undercut section, and the projection 18 is sized such that its bifurcations at opposite sides of the slot 19 are squeezed together when pressed into the slot 14 for a secure snap-fit mounting. Preferably, the mounting projections 18 are much longer than the width of a slot 14 to prevent substantial rotation of the container when mounted but substantially shorter than the width of the container so that the container can overhang the ends of the slots 14.

Each container is of a height approximately equal to the distance between the rows 12 of numbered squares and of a width approximately equal to the width of a numbered square. Preferably, each container has four separate compartments 20, two at the top and two at the bottom, with a separate lid 21 for each such compartment. The lids can have finger tabs 22 projecting outward opposite the hinged edges 23 of the lids for convenient access by the user. Interfitting detent fingers 24 hook over the outer sides of the containers to retain the lids closed until opened for filling or emptying. Preferably, such outer sides curve inward from the lids 21 to form a recess 25 for more convenient finger access to the tabs 22.

As best seen in FIG. 4, rearward-rrojecting stiffening ribs 26 are formed integrally with the front panel 4 and extend lengthwise along the opposite inner margins of each slot 14. In addition, wider vertical ribs 27 extend between horizontal ribs 26 of adjacent slots. Preferably, the vertical ribs are positioned between date-indicating squares of the calendar sheet so as not to obstruct the numbers and have downward and inward angled or rounded top edges for easy insertion of the calendar sheet. As seen in FIG. 2, the inner edges of the vertical ribs 27 are closely adjacent to the backing board 3 to limit inward flexing of the front panel 4 as the containers 16 are mounted. The separate top insert card 28 extending upward above the calendar sheet 2 can be used for personalized information, such as quick reference medical information and emergency telephone numbers.

Assuming an adequate supply of pharmaceutical pills, the compartments of the separate containers 16 need be loaded only once each month, whereupon the containers can be mounted on the front panel 4 of the calendar holder 1 adjacent to each date-indicating square. The horizontal rows of containers are aligned with the blank spaces between the numbered rows of the calendar sheet and are spaced apart for easy viewing of the numbers. The user may find it convenient to remove the container at the end of the day or after the last daily dose is taken for an additional reminder of the date.

I claim:

1. A pill dispenser comprising a calendar including an insert calendar sheet and a substantially rigid holder for said calendar sheet, said holder including a substantially planar front panel, and several separate reusable containers each manually attachable to and detachable from said holder.

2. The pill dispenser defined in claim 1, in which the holder includes a substantially planar back panel, a substantially planar front panel approximately parallel to but spaced outward from said back panel for reception of the calendar sheet therebetween, said front panel being transparent for viewing of the calendar sheet through said front panel.

3. The pill dispenser defined in claim 1, in which the calendar sheet has rows of date-indicating indicia, and including a separate container for each date.

4. The pill dispenser defined in claim 3, in which each container has a plurality of compartments and is mountable adjacent to one of the date-indicating indicia.

5. The pill dispenser defined in claim 1, in which the front panel and the containers have cooperating recesses and projections forming snap-fit connections of the containers to the front panel.

6. The pill dispenser defined in claim 5, in which the front panel is disposed upright and includes a plurality of vertically spaced, horizontally extending slots, each of the containers having a rearward-extending mounting projection fittable in one of said slots.

7. The pill dispenser defined in claim 6, in which each projection is elongated horizontally to deter twisting of the container relative to the front panel when the projection of such container is fitted in a slot.

8. The pill dispenser defined in claim 6, in which each rearward-extending mounting projection has top and bottom bifurcations separated by a horizontal slot.

9. The pill dispenser defined in claim 6, in which the slots have undercut marginal portions.

10. The pill dispenser defined in claim 6, in which the front panel has integral first stiffening ribs extending lengthwise along the slots.

11. The pill dispenser defined in claim 10, in which the front panel has integral second stiffening ribs extending between the first ribs.

12. The pill dispenser defined in claim 1, in which the front panel has integral stiffening ribs.

13. The pill dispenser defined in claim 12, in which the holder includes a planar back panel approximately parallel to but spaced rearward from the front panel, the inner edges of the ribs being disposed closely adjacent to said back panel to limit inward flexing of the front panel relative to said back panel.

14. The pill dispenser defined in claim 1, in which the holder includes a planar back panel approximately parallel to but spaced rearward from the front panel, said back panel and front panel being disposed upright, said back panel having a top portion extending above the top edge of the front panel.

15. The pill dispenser defined in claim 14, including a separate insert card fitted in the holder for personalized information and extending over the top portion of the back panel.

16. The pill dispenser defined in claim 1, in which each container has a plurality of compartments and a lid for each compartment.

17. The pill dispenser defined in claim 16, in which each lid has an outward-projecting finger tab and an outer side having a recess adjacent to said tab for access to said tab.

* * * * *